US007541747B2

(12) United States Patent
Shinmen et al.

(10) Patent No.: US 7,541,747 B2
(45) Date of Patent: Jun. 2, 2009

(54) MULTIPLE DISCHARGE LAMP LIGHTING APPARATUS

(75) Inventors: Hiroshi Shinmen, Kitasaku-gun (JP); Robert Weger, Wels (AT)

(73) Assignee: Minebea Co., Ltd, Kitasaku (JP)

( * ) Notice: Subject to any disclaimer, the term of this patent is extended or adjusted under 35 U.S.C. 154(b) by 98 days.

(21) Appl. No.: 11/665,272

(22) PCT Filed: Oct. 21, 2005

(86) PCT No.: PCT/JP2005/019403

§ 371 (c)(1),
(2), (4) Date: May 9, 2007

(87) PCT Pub. No.: WO2006/051676

PCT Pub. Date: May 18, 2006

(65) Prior Publication Data

US 2008/0042593 A1 Feb. 21, 2008

(30) Foreign Application Priority Data

Nov. 10, 2004 (JP) ..... 2004-326495

(51) Int. Cl.
*H05B 41/24* (2006.01)

(52) U.S. Cl. ..... 315/255; 315/277; 315/213; 315/224

(58) Field of Classification Search ..... 315/244, 315/227 R, 294, 86, 70, 7, 175, 243, 310, 315/254, 274, 101, 172, 58, 195, 272, 228, 315/290, 221, 189, 238, 119, 212, 312, 225, 315/223, 205, 127, 200 R, 255; 363/16, 363/37, 131, 97, 23, 132, 56.05, 98, 9.1, 363/64, 10.1, 112, 326
See application file for complete search history.

(56) References Cited

U.S. PATENT DOCUMENTS

| | | | | |
|---|---|---|---|---|
| 6,717,372 | B2 * | 4/2004 | Lin et al. | 315/282 |
| 2003/0001524 | A1 | 1/2003 | Lin et al. | |
| 2003/0141829 | A1 | 7/2003 | Yu et al. | |
| 2004/0105288 | A1 * | 6/2004 | Watanabe et al. | 363/132 |

FOREIGN PATENT DOCUMENTS

| | | |
|---|---|---|
| JP | A 7-045393 | 2/1995 |
| JP | A 2000-181384 | 6/2000 |
| JP | B2 3256992 | 12/2001 |
| JP | A 2002-175891 | 6/2002 |
| JP | A 2003-031383 | 1/2003 |
| WO | WO 2004/017508 A1 | 2/2004 |

* cited by examiner

*Primary Examiner*—Douglas W Owens
*Assistant Examiner*—Jae K Kim
(74) *Attorney, Agent, or Firm*—Oliff & Berridge, PLC

(57) ABSTRACT

There is provided a multiple discharge lamp lighting apparatus, which includes an inverter and plurality of inverter transformer. In the multiple discharge lighting apparatus, a discharge lamp is connected to the secondary winding of each inverter transformer, a ballast impedance element is connected in series between a switch of the inverter and the primary winding of each inverter transformer, and a current balancing unit is provided between each two adjacent inverter transformers.

3 Claims, 3 Drawing Sheets

MULTIPLE DISCHARGE LAMP LIGHTING APPARATUS

BACKGROUND OF THE INVENTION

1. Field of the Invention

The present invention relates to a lamp lighting apparatus to drive a plurality of discharge lamps (multiple discharge lamp lighting apparatus), and particularly to a multiple discharge lamp lighting apparatus to drive cold cathode lamps or the like used as a light source of a backlight system for a liquid crystal display device.

2. Description of the Related Art

A discharge lamp, for example, a cold cathode lamp, is extensively used as a light source of a backlight system for a liquid crystal display (LCD) device, and such a discharge lamp is usually AC driven by a discharge lamp lighting apparatus provided with an inverter. Recently, as an LCD device becomes larger in size for a higher brightness, a multiple lamp backlight device adapted to drive a plurality of discharge lamps is more and more used as a lighting source for an LCD device.

Generally, a high voltage is required for driving a discharge lamp, and therefore a discharge lamp lighting apparatus usually includes an inverter transformer to generate a high voltage at the secondary side. An inverter means to generate a high frequency voltage is provided at the primary side of the inverter transformer, while a discharge lamp having a negative resistance characteristic, and a so-called ballast element, such as a ballast capacitor, to stabilize the lamp current of the discharge lamp are provided at the secondary side of the inverter transformer. In a conventional multiple discharge lamp lighting apparatus to drive a plurality of discharge lamps, a ballast capacitor is connected to each of the discharge lamps (refer to, for example, Patent Document 1).

A multiple discharge lamp lighting apparatus is required to provide a uniform lamp current for all discharge lamps in order to achieve a uniform brightness among all the discharge lamps. However, if an individual ballast capacitor is connected to each of the plurality of discharge lamps, the characteristic variation among the individual ballast capacitors may possibly cause lamp current variation among the discharge lamps. To cope with this variation problem, a multiple discharge lamp lighting apparatus is disclosed which includes a circuitry in which a balance coil is provided at the secondary side of an inverter thereby uniformizing the lamp currents of all the discharge lamps (refer to, for example, Patent Document 2). Also, another multiple discharge lamp lighting apparatus is disclosed which includes a circuitry in which electric power is supplied from a low voltage constant current source provided at the primary side of an inverter thereby eliminating requirement of a ballast capacitor (refer to, for example, Patent Document 3), and this circuitry is expected to have a certain effect on achieving a uniform lamp current for the plurality of discharge lamps.

Patent Document 1: Japanese Patent Application Laid-Open No. 2002-175891

Patent Document 2: Japanese Patent Application Laid-Open No. H7-45393

Patent Document 3: Japanese Patent No. 3256992

DISCLOSURE OF THE INVENTION

Problems to be Solved by the Invention

However, the multiple discharge lamp lighting apparatuses described above are accompanied with the following problems.

The multiple discharge lamp lighting apparatus disclosed in Patent Document 1 encounters, in addition to the aforementioned lamp current variation, a problem that an output voltage including the voltage drop of the ballast capacitor connected in series to the discharge lamp must be generated at the secondary side, which causes an increase in the dimension of the inverter transformer thus hindering downsizing of the apparatus.

Also, the multiple discharge lamp lighting apparatus disclosed in Patent Document 2 faces a problem that the balance coil provided at the secondary side is required to have a large inductance and so must be constituted by a large-size element thus inviting an increase in cost and a difficulty in downsizing.

And, the multiple discharge lamp lighting apparatus disclosed in Patent Document 3 may be free from the problems described above but has the following problem with its circuitry. Since a discharge lamp lighting apparatus, when used as a backlight for an LCD device, usually shares a power supply, specifically a constant voltage power supply, with a liquid crystal drive circuit, and the like, provision of a constant current source for the discharge lamp lighting apparatus results in adding an extra component to the entire assembly device thus increasing the total cost.

The present invention has been made in light of the problems described above, and it is an object of the present invention to provide a multiple discharge lamp lighting apparatus in which the lamp currents of a plurality of discharge lamps are stabilized and uniformed inexpensively without providing a ballast capacitor at the secondary side of an inverter transformer.

Means For Solving The Problems

In order to achieve the object described above, according to an aspect of the present invention, there is provided a multiple discharge lamp lighting apparatus to drive a plurality of discharge lamps, which includes: an inverter means including a switch means and functioning to output a high frequency voltage; and a plurality of inverter transformers each having a discharge lamp connected at a secondary winding thereof, and which further includes: a plurality of ballast impedance elements each connected in series between the switch means and a primary winding of each inverter transformer; and a plurality of current balancing means each disposed between respective primary side wirings of adjacent two of the plurality of inverter transformers.

In the aspect of the present invention, the ballast impedance elements may each include at least one of an inductor and a capacitor.

In the aspect of the present invention, the current balancing means may each include a balance coil.

Effect of the Invention

Since the multiple discharge lamp lighting apparatus of the present invention includes a ballast impedance element connected in series between the switch means and the primary winding of the inverter transformer, the lamp current can be stabilized without a ballast element provided at the secondary side and also with no additional components provided to an apparatus of a conventional structure. Also, since a current balancing means is provided between the respective primary side wirings of each adjacent two inverter transformers, the currents flowing in the primary windings can be equalized independent of the variation of the ballast impedance element connected at the primary winding of each inverter transformer. In addition, since a discharge lamp is connected directly to the second winding of the inverter transformer without a ballast element provided therebetween, the lamp current of the discharge lamp is free from the influence of characteristic variation of a ballast element, thus successfully equalizing the lamp currents of all the discharge lamps.

Also, according to the present invention, since a ballast impedance element is provided at the primary side of the inverter transformer rather than at the secondary side with a high voltage, an element of a high withstand voltage is not required, which reduces the component cost and also eliminates the malfunction and the firing hazard due to the element's insulation breakdown thus enhancing the safety of the apparatus. Further, since there is no need for a ballast element to be connected in series to the discharge lamp at the secondary side of the inverter transformer, the output power of the inverter transformer can be held low. And, even when a short circuit occurs in the secondary winding of the inverter transformer (a layer short), the ballast impedance element provided at the primary side reduces the excessive current flowing in the winding thereby preventing the fuming or firing hazard at the inverter transformer.

In case of using an inductor as a ballast impedance element, the inductor, when provided at the primary side of the inverter transformer, is allowed to have its inductance set smaller than when provided at the secondary side, thus enabling downsizing of the ballast impedance element. Also, since the high order harmonic component can be suppressed by the inductor provided at the primary side, the waveform of the input applied to the inverter transformer can be denoised, and therefore the inverter transformer can be suppressed from generating heat due to the harmonic component thus reducing the heat generation at the inverter transformer as a whole.

And, in case of using a balance coil as a current balancing means, the balance coil, when provided at the primary side of the inverter transformer, does not have to adopt a high withstand voltage structure and also is allowed to have its inductance set low unlike when provided at the secondary side, thus enabling downsizing.

BEST MODE FOR CARRYING OUT THE INVENTION

An exemplary embodiment of the present invention will hereinafter be described with reference to the accompanying drawings.

Figure 1:
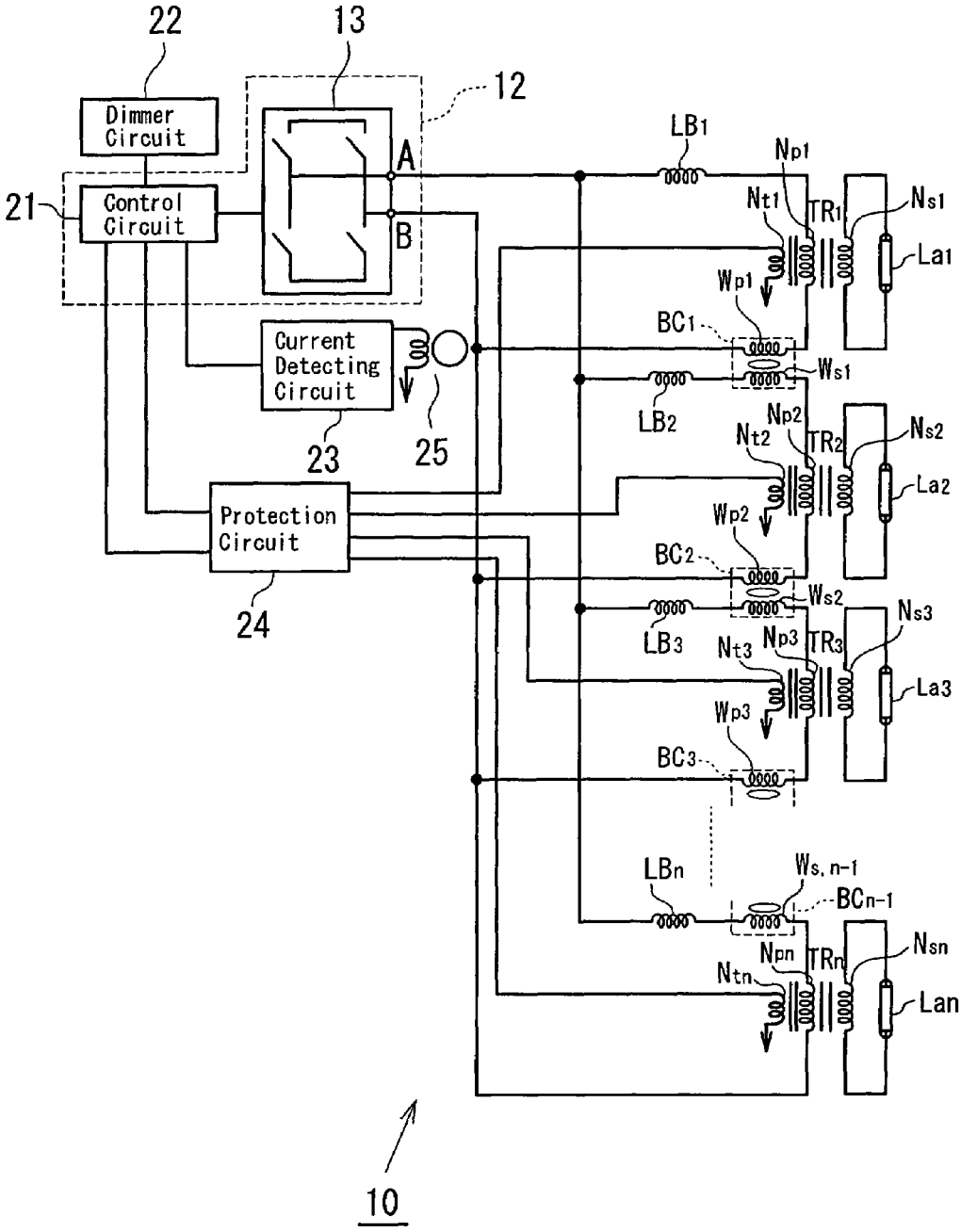
FIG. 1 is circuit diagram of a multiple discharge lamp lighting apparatus according to one embodiment of the present invention.

Referring to FIG. 1, a circuit diaphragm of a multiple discharge lamp lighting apparatus 10 according to one embodiment of the present invention drives a plurality (n units) of discharge lamps La1 to Lan, and generally includes an inverter means 12, and a plurality (n units) of inverter transformers $TR_1$ to $TR_n$. The aforementioned discharge lamps La1 to Lan, for example cold cathode lamps, are connected directly to respective secondary windings Ns1 to Nsn of the inverter transformers $TR_1$ to $TR_n$ without ballast element provided therebetween. The inverter transformers $TR_1$ to $TR_n$ are each connected in parallel to a switch means 13 included in the inverter means 12, such that an inductor LB1 (to LBn) as a ballast impedance element is connected in series to each of primary windings Np1 to Npn of the inverter transformers $TR_1$ to $TR_n$.

Figure 2:
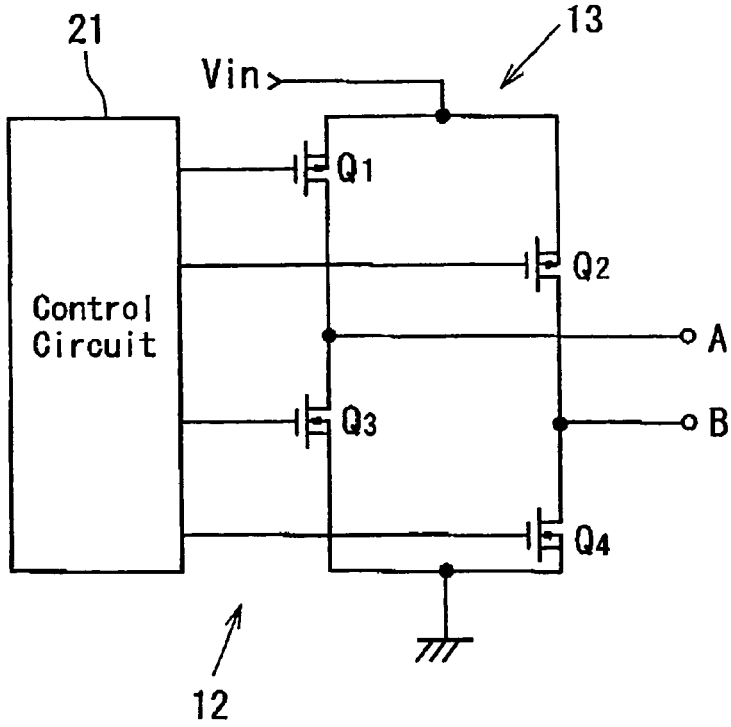
FIG. 2 is a circuit diagram of an inverter means of the multiple discharge lamp lighting apparatus of FIG. 1.

The inverter means 12 includes a full bridge circuit constituting the aforementioned switch means 13 (switch means 13 may hereinafter be referred to as full bridge circuit 13 as appropriate), and a control circuit 21 to drive the full bridge circuit 13. Referring to FIG. 2, the full bridge circuit 13 is structured such that a pair of switching elements Q1+Q3 connected in series to each other are connected in parallel to a pair of switching elements Q2+Q4 connected in series to each other, wherein, for example, the switching elements Q1 and Q2 are constituted by PMOSFET, and the switching elements Q3 and Q4 are constituted by NMOSFET. The inverter means 12 alternately repeats turning on and off two groups of the switching elements ("Q1+Q4" and "Q2+Q3") at a predetermined frequency (about 60 kHz, for example) according to the gate voltage outputted from the control circuit 21, thereby converting a DC voltage Vin into a high frequency voltage and then outputting at its output terminals A and B.

Referring back to FIG. 1, the multiple discharge lamp lighting apparatus 10 further includes a balance coil $BC_i$ (i=1, 2, . . . , n−1) as a current balancing means provided between respective one primary side wirings of two adjacent inverter transformers $TR_i$ and $TR_{i+1}$ out of the inverter transformers $TR_i$ to $TR_n$. The balance coil $BC_i$ includes a primary winding Wpi and a secondary winding Wsi both wound around a magnetic core, and the structure and operation of the balance coil $BC_i$ will be described later.

The inverter transformers $TR_1$ to $TR_n$, which are connected in parallel to the switch means 13, have the following connection mode. For example, as to the connection of the inverter transformer $TR_2$, one terminal of a primary winding Np2 of the inverter transformer $TR_2$ is connected in series to one terminal of a secondary winding Ws1 of a balance coil $BC_1$, with the other terminal of the secondary winding Ws1 connected to one terminal of an inductor LB2 which has its other terminal connected to the output terminal A of the inverter means 12, while the other terminal of the primary winding Np2 of the inverter transformer $TR_2$ is connected to one terminal of a primary winding Wp2 of a balance coil $BC_2$, with the other terminal of the primary winding Wp2 connected to the output terminal B of the inverter means 12. The inverter transformers $TR_3$ to $TR_{n-1}$ are connected in the same way as the inverter transformer $TR_2$, though not entirely illustrated. As to the inverter transformers $TR_1$ and $TR_n$, since the inverter transformer $TR_1$ has its primary side wiring connected to the primary side wiring of the inverter transformer $TR_2$ alone, one terminal of a primary winding Np1 of the inverter transformer $TR_1$ is connected directly to the inductor LB1, and since the inverter transformer $TR_n$ has its primary side wiring connected to the primary side wiring of the inverter transformer $TR_{n-1}$ alone, one terminal of a primary winding Npn of the inverter transformer $TR_n$ is connected directly to the output terminal B of the inverter means 12.

The multiple discharge lamp lighting apparatus 10 includes, in addition to the constituent members described above, a dimmer circuit 22, a current detecting circuit 23, and a protection circuit 24. While the present invention is feasible without regard to the use of these circuits 22, 23 and 24, a brief description will be made on the circuits 22, 23 and 24 as follows.

The current detecting circuit 23 generates an adequate signal according to the value of a current detected by a current transformer 25 and outputs the signal to the control circuit 21, which then, according to the signal, varies the on-duty of the switching elements Q1 to Q4 of the inverter means 12, thereby regulating the electric power applied to the inverter transformers $TR_1$ to $TR_n$. The protection circuit 24 generates an adequate signal according to the value of a voltage detected by tertiary windings Nt1 to Ntn of the inverter transformers $TR_1$ and $TR_n$ and outputs the signal to the control circuit 21, which then deactivates the inverter means 12 according to the signal when a malfunction, for example, an open circuit or a short circuit at the discharge lamps $La_1$ to $La_n$, is detected, thereby protecting the device associated. The dimmer circuit 22 outputs a signal to modulate the brightness of the discharge lamp La by, for example, burst dimming, to the control circuit 21, which then, according to the signal, activates intermittently the inverter means 12 at a frequency, for example, 150 to 300 Hz, thereby averaging the brightness of the discharge lamps La1 to Lan. The current detecting circuit 23 detects a current at the current transformer 25 in the embodiment shown, but may alternatively be adapted to detect a lamp current at the discharge lamp La.

Figure 3:
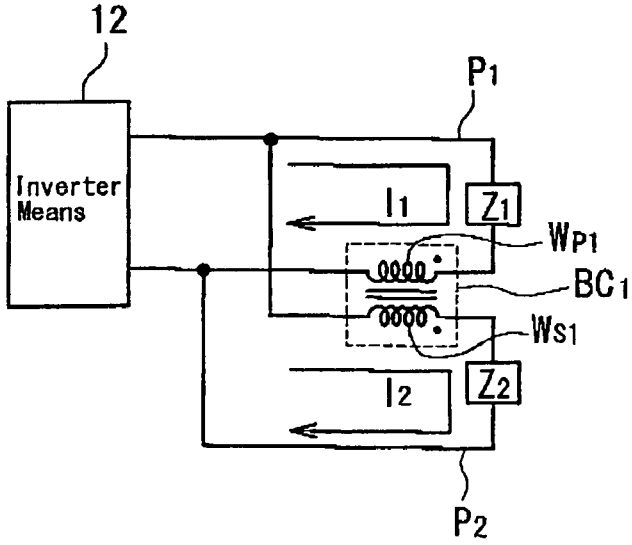
FIG. 3 is a circuit diagram of a relevant portion of the multiple discharge lamp light apparatus of FIG. 1, explaining an operation of a balance coil.

The structure and operation of the balance coils ($BC_1$ to $BC_{n-1}$) as a current balancing means in the present embodiment will now be described taking the balance coil $BC_1$ as an example. FIG. 3 shows respective relevant portions of a primary side wiring P1 of the inverter transformer $TR_1$ and a primary side wiring P2 of the inverter transformer $TR_2$ in the multiple discharge lamp lighting apparatus 10. Z1 and Z2 shown in FIG. 3 represent impedances of other circuit elements than the balance coil $BC_1$, that are connected or deemed as connected respectively to the primary wirings P1 and P2, and include respective impedances of the inductors LB1 and LB2, respective equivalent resistances of the discharge lamps La1 and La2 seen from the primary sides of the inverter transformers $TR_1$ and $TR_2$, and the like. The balance coil $BC_1$ includes a primary winding Wp1 and a secondary winding Ws1 which are wound around a magnetic core with the same turn number and in the same phase as each other and tightly coupled to each other. In the present embodiment, the impedances of the primary and secondary windings Wp1 and Ws1 are sufficiently larger than the aforementioned impedances Z1 and Z2.

Currents I1 and I2 flow respectively in the primary and secondary windings Wp1 and Ws1 in the directions opposite to each other as shown in FIG. 3, where a voltage corresponding to $\Delta I = I1 - I2$ is generally generated across the terminals of the primary and secondary windings Wp1 and Ws1. Since the primary and secondary windings Wp1 and Ws1 of the balance coil $BC_1$ have sufficiently large impedances, the currents I1 and I2 are equilibrated with each other thus reducing $\Delta I$ to substantially zero independent of the variation or fluctuation of the impedances Z1 and Z2. In this case, almost all the magnetic fluxes generated in the balance coil $BC_1$ by the currents I1 and I2 are caused to cancel out each other, and therefore the impedance of the balance coil $BC_1$ itself at operation can be regarded as substantially zero. The same current equilibration is performed at the other balance coils $BC_2$ to $BC_{n-1}$ thereby equalizing currents flowing in the primary side wirings of the inverter transformers $TR_1$ to $TR_n$.

In the multiple discharge lamp lighting apparatus 10 according to the present embodiment, the inductors LB1 to LBn are connected in series respectively to the primary windings Np1 to Npn of the inverter transformers $TR_1$ and $TR_n$, and function as a ballast impedance element thereby stabilizing the lamp currents of the discharge lamps La1 to Lan. While their operation will be described below in association with the inductor LB1, the other inductors LB2 to LBn operate in the same way.

For example, when the lamp current of the discharge lamp La1 (hereinafter referred to as "secondary side current" as appropriate) is increased for some reason, the current flowing in the primary winding Np1 (hereinafter referred to as "primary side current" as appropriate) is caused to increase also, wherein since the voltage applied by the inverter means 12 is constant, and since the impedance of the balance coil $BC_1$ is regarded as zero as described above, the impedance due to the inductance of the inductor LB1 acts to decrease the primary side current, which results in suppressing the increase of the secondary side current. And, when the secondary side current is decreased, the primary side current is caused to decrease also, and the impedance due to the inductance of the inductor LB1 acts to increase the primary side current resulting in suppressing the decrease of the secondary side current.

The equivalent load resistance seen from the primary side of the inverter transformer $TR_1$ is defined as $R/N^2$ where: N is the winding ratio (secondary winding number/primary winding number) of the inverter transformer $TR_1$; and R is the equivalent resistance of the discharge lamp $La_1$, and so it suffices that a ballast impedance element has an impedance value sufficiently large compared with $R/N^2$.

The present invention is feasible independent of the kind of impedance element, and a resistor, a capacitor, or an inductor may be used singly or in any combination thereof as a ballast impedance element, while a ballast impedance element is preferably constituted by an inductor as shown in the embodiment described above, or by a combination including an inductor. In the multiple discharge lamp lighting apparatus according to the present invention, provision of a ballast impedance element at the primary side of an inverter transformer eliminates the necessity of using a high withstand voltage element, and accordingly allows an inductor, which is lower in power loss than a resistor, to be used favorably as a ballast element without paying attention to the consideration that an inductor for high voltage use is inevitably subject to an increase in dimension, which is a drawback of an inductor. In addition, since the load resistance seen from the primary side of an inverter transformer is reduced to about $1/N^2$ as described above, the inductance can be reduced to about $L/N^2$ compared with the case where an inductor functioning equivalently to a ballast element is provided at the secondary side, thus enabling further downsizing of the element. In the multiple discharge lamp lighting apparatus 10 arranged, for example, such that the winding ratio N of the inverter transformer $TR_1$ is set to 100, the inductor LB1 having its inductance L set at about 30 μH is adapted to achieve a functional capability equivalent to that of an inductor having an inductance L of about 300 mH and provided at the secondary side as a ballast element.

Also, the balance coils $BC_1$ to $BC_{n-1}$ are provided at the primary sides, rather than at the secondary sides, of the inverter transformers $TR_1$ to $TR_n$ thereby eliminating the necessity of using a high withstand voltage element, and an inductance for achieving a practical current equilibration can be reduced thus enabling downsizing of the element.

For the purpose of showing one of the advantages achieved by providing a ballast impedance element at the primary side, description will now be made on how the multiple discharge lamp lighting apparatus 10 operates when a short circuit in a winding (what is called "layer short") is caused at the secondary side of the inverter transformers $TR_1$ to $TR_n$.

In a conventional multiple discharge lamp lighting apparatus, when a layer short is caused at the secondary winding of any one of inverter transformers, a resistor $r_s$ at the area of the secondary winding having a short circuit becomes connected to the secondary side thus causing an excessive current to flow in the inverter transformers and possibly prompting fuming and firing hazard. At this time, the power loss at the short circuit is represented as:

$$P=Vp^2/rp$$

where Vp is the voltage at the primary side of the inverter transformer, and rp is the load resistance due to a layer short seen from the primary side. On the other hand, in the multiple discharge lamp lighting apparatus 10 according to the present embodiment, if a layer short occurs, for example, in the secondary winding Ns1 of the inverter transformer $TR_1$, the power loss at the short circuit area is represented as:

$$P=rp.Vp^2/((\omega L)^2+rp^2)$$

where L is the inductance of the inductor LB1, which shows that the power loss, that is to say heat generation due to an excessive current, is reduced by the impedance of the inductor LB1.

Also, the inductors LB1 to LBn each function as s low pass filter and are adapted to reject the harmonic component of the output voltage of the inverter means 12 thereby making the waveform of the voltage applied to the primary winding Np into a substantially sinusoidal waveform. Accordingly, the inverter transformers $TR_1$ to $TR_2$ are denoised and also suppressed from suffering heat generation caused due to the harmonic component.

Further, the inverter means 12 is a high efficiency separately excited circuit including the full bridge circuit 13 and the control circuit 21, wherein the full bridge circuit 13 is driven by the control circuit 21 at a predetermined frequency. Accordingly, unlike, for example, a Royer circuit in which a driving frequency for an inverter means is determined by the resonance frequency of an LC resonance circuit provided at the primary side of an inverter transformer, an element having an impedance and suitable as a ballast can be provided at the primary side without giving consideration to the impact on a resonance frequency.

Figure 4:
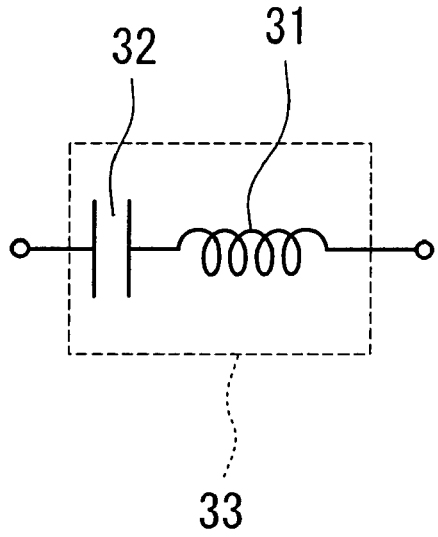
FIG. 4 is a circuit diagram of an alternative ballast impedance element according to the present invention.
Figure 5:
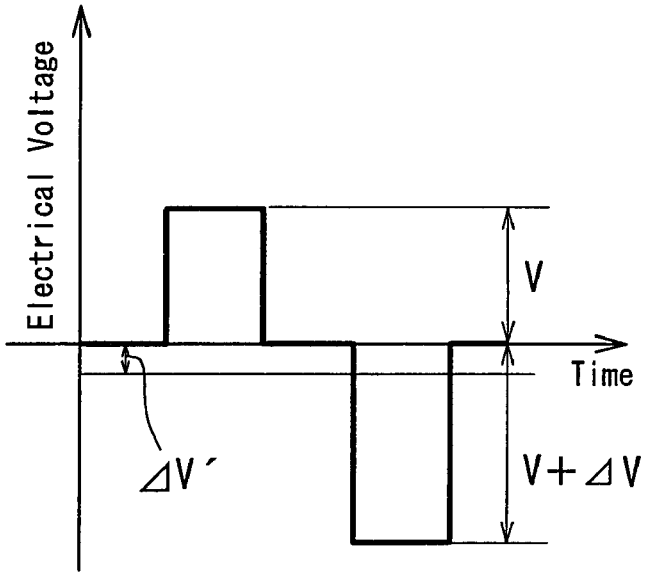
FIG. 5 is a schematic graph of an asymmetric voltage waveform of an inverter means.

The present invention is not limited in structure to the multiple discharge lamp lighting apparatus 10 as described above. For example, the ballast impedance element may be constituted by a series circuit 33 including a capacitor 32 as well as an inductor 31 as shown in FIG. 4, rather than constituted by an inductor alone as described above. This alternative structure will achieve the following advantages in addition to those described above. When the inverter means 12 involves an asymmetric output waveform having a voltage V in one direction and a voltage V+ΔV in the other direction as shown in FIG. 5, a DC voltage with an average voltage of ΔV' (ΔV' is the time averaged voltage of ΔV) is superposed to the output voltage. Under the circumstances described above, if the ballast impedance element is composed of the inductor 31 alone, a large DC current is superposed to the inverter transformers $TR_1$ to $TR_n$, which causes magnetic saturation and efficiency deterioration. In such a case, the DC component of the asymmetric voltage waveform can be cut by connecting the capacitor 32 in series between the inverter means 12 and the inductor 31, and the symmetry of the voltage applied to the primary winding Np of the inverter transformer TR is improved.

Also, a capacitor may be connected in parallel to each of the primary windings Np1 to Npn of the inverter transformers $TR_1$ to $TR_n$, whereby the resonance frequency of a resonance circuit at the secondary side is regulated so as to stabilize a lamp current, and at the same time the harmonic component of the output voltage of the inverter means 12 is more effectively rejected so that the waveform of the voltage applied to the primary winding Np can be made into a substantially sinusoidal waveform.

What is claimed is:

1. A multiple discharge lamp lighting apparatus to drive a plurality of discharge lamps, the apparatus comprising:

an inverter means comprising a switch means and functioning to output a high frequency voltage;

a plurality of inverter transformers each having a discharge lamp connected at a secondary winding thereof;

a plurality of ballast impedance elements each connected in series between the switch means and a primary winding of each inverter transformer, the primary winding of each inverter transformer being connected in parallel with the switch means; and a plurality of current balancing means each comprising two windings and disposed between two adjacent inverter transformers such that one of the two windings is directly connected between one of two output terminals of the switch means and a terminal of the primary winding of one of the two adjacent inverter transformers, and one end of another of the two windings is connected to another output terminal of the switch means via the balance impedence element and the other end thereof is directly connected to a terminal of the primary winding of another of the two adjacent inverter transformers.

2. A multiple discharge lamp lighting apparatus according to claim 1, wherein the ballast impedance elements each comprise at least one of an inductor and a capacitor.

3. A multiple discharge lamp lighting apparatus according to claim 1, wherein the current balancing means each comprise a balance coil.

* * * * *